US006362785B1

(12) United States Patent
Nalbandian et al.

(10) Patent No.: US 6,362,785 B1
(45) Date of Patent: Mar. 26, 2002

(54) COMPACT CYLINDRICAL MICROSTRIP ANTENNA

(75) Inventors: Vahakn Nalbandian, Ocean, NJ (US); Choon Sae Lee, Dallas, TX (US)

(73) Assignee: The United States of America as repesented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/430,258

(22) Filed: Oct. 29, 1999

(51) Int. Cl.[7] ..... H01Q 1/38
(52) U.S. Cl. ..... 343/700 MS; 343/846
(58) Field of Search ..... 343/700 MS, 846, 343/848

(56) References Cited

U.S. PATENT DOCUMENTS 4,204,212 A * 5/1980 Sindoris et al. ..... 343/700 MS
4,323,900 A * 4/1982 Krall et al. ..... 343/700 MS
4,806,941 A * 2/1989 Knochel et al. ..... 343/700 MS
4,816,836 A * 3/1989 Lalezari ..... 343/700 MS
5,512,910 A * 4/1996 Murakami et al. ... 343/700 MS
5,561,435 A * 10/1996 Nalbandian et al. . 343/700 MS
5,818,390 A * 10/1998 Hill ..... 343/700 MS
5,898,405 A * 4/1999 Iwasaki ..... 343/700 MS

* cited by examiner

*Primary Examiner*—Don Wong
*Assistant Examiner*—Trinh Do Dinh
(74) *Attorney, Agent, or Firm*—Michael Zelenka; George B. Terechuk

(57) ABSTRACT

A first and a second conductive patch of a compact cylindrical microstrip antenna are connected at a junction point to shorten the length of the impedance transition from one edge, where the wave impedance vanishes, to the other patch edge, where the impedance becomes very large. The second conductive patch is wider than the first conductive patch and one end of the first conductive patch is shorted with the ground plane. The effective impedance to be satisfied by the narrower strip at the junction is greatly reduced by the presence of the junction of two different patches, which substantially decreases the size of the antenna at a given operation frequency.

27 Claims, 3 Drawing Sheets

COMPACT CYLINDRICAL MICROSTRIP ANTENNA

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to the field of microstrip antennas, and more particularly to compact cylindrical microstrip antennas.

BACKGROUND OF THE INVENTION

Microstrip antennas are of lightweight, low profile, low cost and can have a cylindrical and conformal structure, replacing bulky antennas. Monopole antennas are also a low cost type of antenna, but as the monopole antenna's frequency goes down to VHF and lower frequencies, its length becomes too large and cumbersome, making it inapplicable for a number of applications. The length of each microstrip patch is about half of a wavelength within the dielectric medium under the radiating patch. Similarly, the size of an efficient monopole is quarter wavelength. Thus, when the frequency in low, the antenna size becomes larger.

The disadvantage of excessive monopole antenna length cannot be overcome by simply reducing length to less than a quarter wavelength, because the monopole antenna quickly loses its efficiency. Up until now, it has not been possible to employ microstrip antennas without the disadvantages, limitations and shortcomings associated with antenna length and size. The present invention makes it possible to have electrically small cylindrical microstrip antennas at low frequencies with a monopole-type radiation pattern. With this invention, an omni-directional compact microstrip antenna is provided for both VHF and even lower frequencies.

An electrically small cylindrical microstrip antenna at low frequencies offers a number of advantages over prior art antennas. The compact cylindrical microstrip antenna of the present invention provides the same high efficiency as a quarter wavelength monopole and conventional microstrip antennas, with the key advantage over prior art antenna structures of a substantially shorter antenna length. In addition to the advantages of high efficiency and small size, the present invention provides omnidirectional azimutahl patterns useful in many military and commercial communication systems, without suffering from the size limitations of prior art antenna structures.

SUMMARY OF THE INVENTION

It is an object of the present invention to provide a cylindrical microstrip antenna structure.

Another object of the present invention is to provide an electrically small cylindrical microstrip antenna with a radiation pattern similar to a monopole having a reduced antenna length that operates at low frequencies such as UHF and VHF.

These and other objects are advantageously accomplished with the present invention by providing a compact cylindrical microstrip antenna comprising a microstrip substrate wrapped around a section of a cylindrical ground plane, with conductive patches disposed on the microstrip substrate. In one embodiment of the present invention, a reduced antenna length of at least 10% of the length of a conventional microstrip antenna has been achieved, resulting in small microstrip antennas at lower frequencies.

DETAILED DESCRIPTION OF THE DRAWINGS

Figure 1:
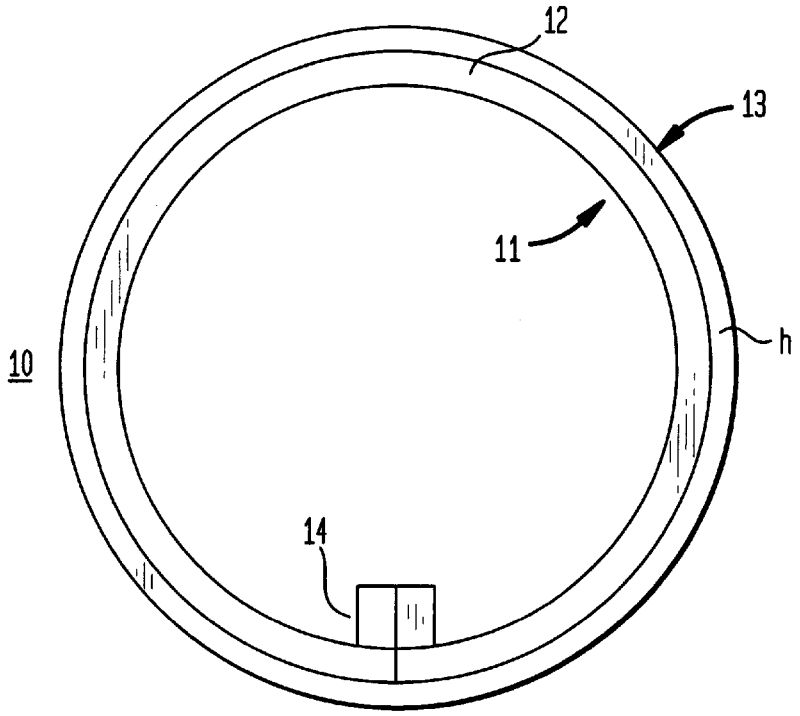
FIG. 1 is a cross sectional view of the compact cylindrical microstrip antenna of the present invention.
Figure 2:
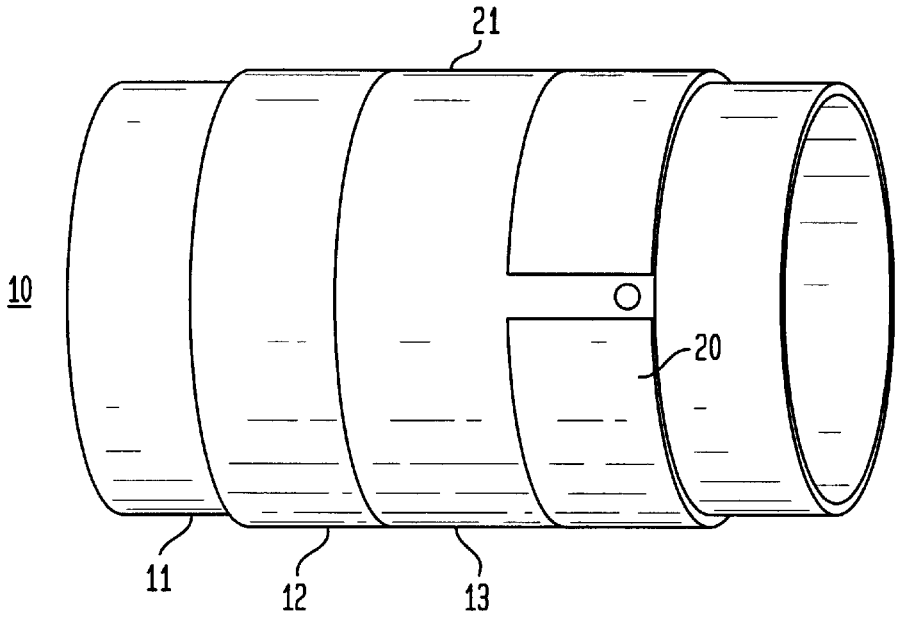
FIG. 2 is an exploded side view of the conductive patch means disposed on the microstrip substrate to form the compact cylindrical microstrip antenna of the present invention.

Referring now to FIG. 1, there is depicted a cross sectional view of the compact cylindrical microstrip antenna 10 of the present invention. The cylindrical microstrip antenna 10 comprising a cylindrical ground plane 11 enclosed by a microstrip substrate 12. A conductive patch means 13 is wrapped around microstrip substrate 12, which fits closely around the ground plane 11 like a collar and functions as a microstrip antenna. RF Connector, or SMA 14, is disposed within the cylindrical ground plane 11 and is connected to the conductive patch means 13. The cylindrical ground plane 11 is hollow. The conductive patch means 13 has a patch thickness, h. FIG. 2, which is a perspective view of the antenna 10 employing like numerals, more clearly depicts the microstrip substrate 12 wrapped around a section of the cylindrical ground plane 11, with a conductive patch means 13 disposed on the microstrip substrate 12. The conductive patch means 13 further comprising a first patch 20, a second patch 21, with the first patch 20 substantially narrower than second patch 21.

The length of cylindrical microstrip antenna 10 is determined by the wavelength in microstrip substrate 12. For example, the length of a rectangular microstrip antenna is about a half a wavelength within the dielectric medium under the radiating patch. In order to reduce the size of conductive patch means 13, the dielectric constant of microstrip substrate 12 must be increased substantially for a smaller effective wavelength in the medium. It is difficult to reduce the size of conductive patch means 13 because materials with a large dielectric constant and low loss are not readily available, and the antenna efficiency usually goes down with a substrate of high dielectric constant.

Figure 3:
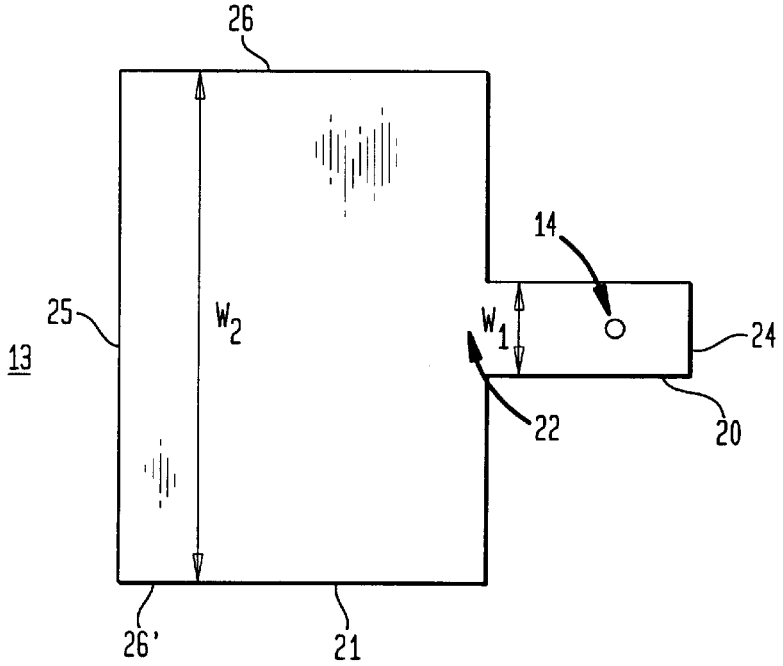
FIG. 3 is a top conceptual view of the conductive patch means employed in all embodiments of the present invention.
Figure 4:
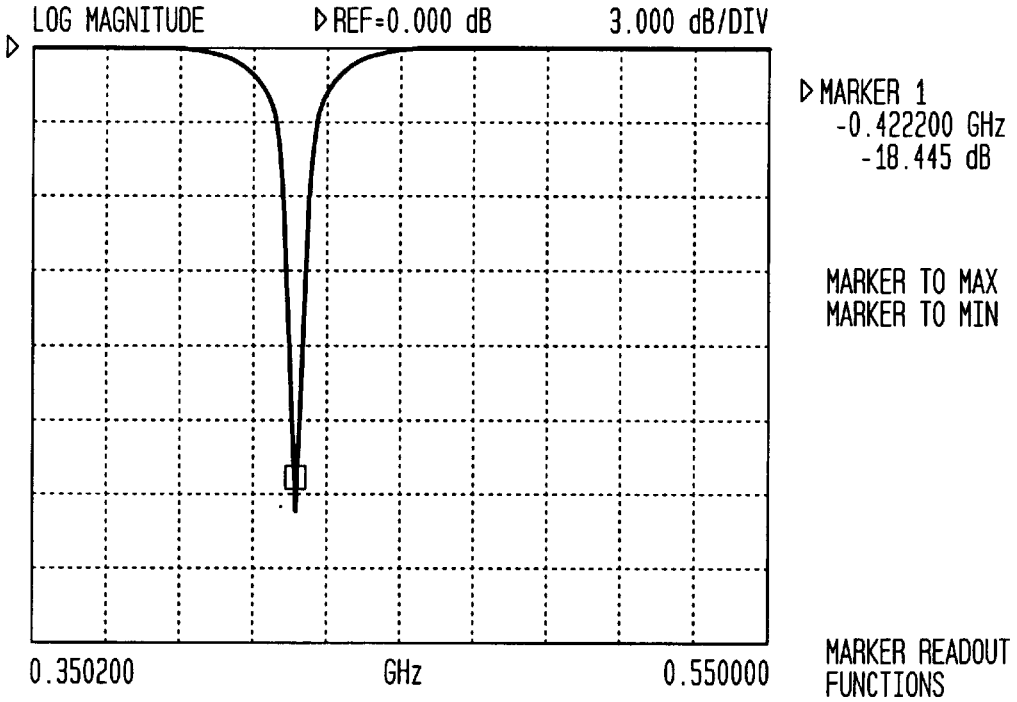
FIG. 4 is a graph showing return loss as a function of frequency for the compact cylindrical microstrip antenna of the present invention.

FIG. 3 is a top conceptual view of the conductive patch means 13 employed in all embodiments of the present invention. This drawing illustrates this invention's basic principle, introducing a junction in the middle of the patch shortening the length of the impedance transition from one patch edge, where the wave impedance vanishes by shortening the edge with a conductive strip, to the other open-ended patch edge, where the impedance becomes very large. FIG. 3 depicts a simple example of two rectangular patches 20 and 21, respectively, of different widths connected at a junction point 22 where one end of the narrow first patch 20 is electrically shorted at ground end 24. The effective resistive impedance near the junction point 22 of second conductive patch 21 is greatly reduced by the presence of the junction of the first and second conductive patches 20 and 21. The inventors have observed experimentally that this antenna radiates at a frequency much lower than the expected frequency of a regular rectangular microstrip antenna. If a conventional rectangular microstrip antenna is used, a much larger structure is required to have the antenna operational at such a low frequency. A small hand-held antenna or a conformal antenna at VHF or lower frequency ranges is now made possible with this new design.

The fields at y=c are larger than the fields at y=c+d, providing bell-shaped radiation patterns. Referring back to FIG. 3, second patch 21 is connected to first patch 20 at the junction point 22. The width, $W_2$, of second patch 21 is greater than the width, $W_1$, of first patch 20.

In operation, by providing junction point 22 the length of the impedance transition is shortened from the point at the edge of ground end 24 of narrow first patch 20, where the wave impedance vanishes, to outer patch edge 25 of wider second patch 21, where the impedance becomes very large. By shorting ground end 24 of the narrower first patch 20, the impedance transition length is decreased to a reduced impedance transition length, thus allowing the antenna length to be reduced in half. By shorting ground end 24 of the narrower first patch 20, the impedance transition length is decreased to a reduced impedance transition length, thus allowing the antenna length to be reduced in half.

The compact cylindrical microstrip antenna of the present invention provides more antenna efficiency than other currently available antennas. This invention's antennas can achieve more than an 80% antenna efficiency, which compares favorably with smaller monopole and dipole antennas of comparable size achieving an antenna efficiency of less than about 10%. The impedance transition length is orthogonal to the second patch width, $W_2$. Also, it is possible that for the SMA to be a coaxial feed.

Figure 5:
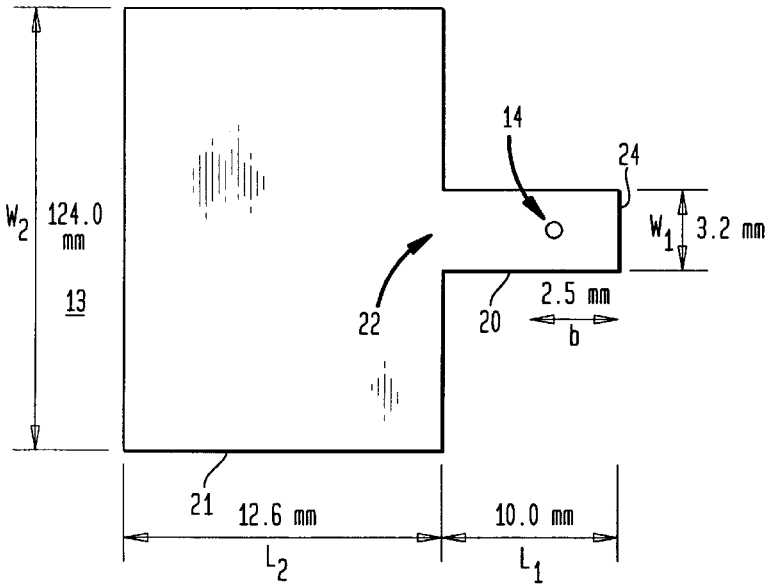
FIG. 5 is a top view of the conductive patch means used in all embodiments of the present invention with representative dimensions.

FIG. 5 is a top view of the conductive patch means 13 with representative dimensions and the same numerals for similar structural elements. Distance b is 2.5 mm between the grounded end 24 and SMA 14. First patch 20 has a length, $L_1$, of 10.0 mm, and second patch 21 is depicted with a second length, $L_2$, of 12.6 mm. The width, $W_1$, of first patch 20 is 3.2 mm and the width, $W_2$, of second patch 21 is 124.0 mm. The patch thickness, h, shown in FIG. 1, is 0.78 mm. The same antennas were fabricated and tested by using microstrip material of dielectric constant of 10.2. The measured resonant frequency of these antennas showed frequency reduction by square root of the ratio of two dielectric constants, as expected.

Figure 6:
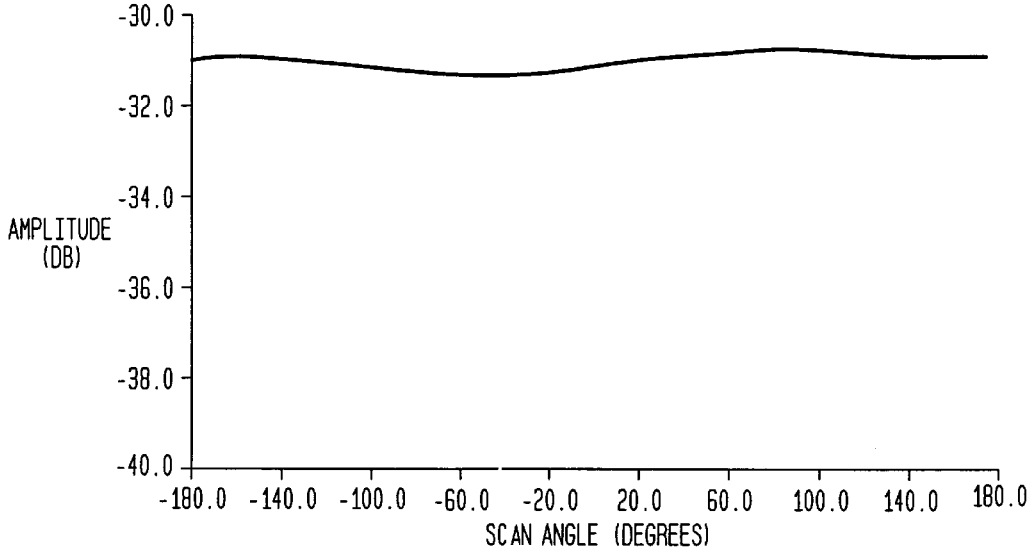
FIG. 6 is a graph showing an H-plane radiation pattern at 422 Mhz using the compact cylindrical microstrip antenna of the present invention.

A prototype cylindrical antenna was fabricated by using 31 mil thick microstrip material (Duroid) with a relative dielectric constant of 2.2, as depicted in FIGS. 1–3. This cylinder's outer diameter was 38.8 mm and total length of the two conductive patches was 22.6 mm. The resonant frequency of this antenna was 422 MHz or only 10% of the frequency found in a conventional rectangular planar antenna. Excellent impedance matching is achieved by adjusting the coaxial feed location relative to-the short. The 360-degree azimuth radiation pattern variation was within 0.5 dB, as shown in FIG. 6. Making the strip width smaller can further reduce the variation in radiation magnitude. Strip width reduction will also improve antenna size shrinkage. Further reductions in antenna size may also be achieved by decreasing a ratio of first patch width, $W_1$, to second patch width, $W_2$.

It will be understood that the embodiments described herein are merely exemplary and that a person skilled in the art may make many variations and modifications to the described embodiments utilizing functionally equivalent elements to those described. Any variations or modifications to the invention just described are intended to be included within the scope of said invention as defined by the appended claims.

What we claim is:

1. A compact cylindrical microstrip antenna, comprising:
   - a cylindrical ground plane is enclosed by a cylindrical, dielectric microstrip substrate;
   - a first conductive patch, being disposed on said microstrip substrate, having a ground end shorted to said ground plane and a first width;
   - a second separate and distinct conductive patch, having a second width greater than said first width, being connected to said first conductive patch at a junction point opposite from said ground end, is disposed substantially around said microstrip substrate;
   - an impedance transition length runs from an outer patch edge of said second conductive patch to said ground end, said first conductive patch protrudes from said second conductive patch; and
   - said junction point causing an electric field that decreases said impedance transition length to a reduced impedance transition length to provide a compact antenna length and an azimuth radiation pattern.

2. The compact cylindrical microstrip antenna, as recited in claim 1, further comprising:
   - said second conductive patch is adjacent to said first conductive patch;
   - an RF connector in proximity to said first conductive patch; and
   - said second conductive patch is wrapped around said microstrip substrate.

3. The compact cylindrical microstrip antenna, as recited in claim 2, further comprising said first conductive patch being rectangular.

4. The compact cylindrical microstrip antenna, as recited in claim 3, further comprising said second conductive patch being rectangular.

5. The compact cylindrical microstrip antenna, as recited in claim 4, wherein impedance matching is provided by adjusting the location of said RF connector relative to the point where said ground end is shorted to said ground plane.

6. The compact cylindrical microstrip antenna, as recited in claim 5, further comprising said RF connector being a coaxial feed.

7. The compact cylindrical microstrip antenna, as recited in claim 6, further comprising said first width of the first conductive patch being decreased to provide a reduced variation in radiation magnitude and a lower frequency.

8. The compact cylindrical microstrip antenna, as recited in claim 7, further comprising a ratio of said first width to said second width being decreased to further reduce said compact antenna length.

9. The compact cylindrical microstrip antenna, as recited in claim 8, further comprising said impedance transition length being orthogonal to said second width.

10. The compact cylindrical microstrip antenna, as recited in claim 9, further comprising
   - said first conductive patch is connected to said RF connector; and said RF connector is disposed on an interior surface of said ground plane.

11. The compact cylindrical microstrip antenna, as recited in claim 10, further comprising said azimuth radiation pattern being about 360°.

12. The compact cylindrical microstrip antenna, as recited in claim 11, further comprising a 360° azimuth radiation pattern.

13. A compact cylindrical microstrip antenna, comprising:

a cylindrical ground plane is enclosed by a cylindrical, dielectric microstrip substrate;

a conductive patch means, having a first patch, a separate and distinct second patch and a ground end shorted to said ground plane, is disposed on said microstrip substrate;

said first patch, being narrower than said second patch, joins said second patch at a junction opposite from said ground end;

said conductive patch means having an impedance transition length from said ground end to an outer patch end, said first conductive patch protrudes from said second conductive patch; and said junction causing an electric field to decrease said impedance transition length to a reduced impedance transition length to provide a compact antenna length and an azimuthal radiation pattern.

14. The compact cylindrical microstrip antenna, as recited in claim 13, further comprising said first patch being conductive.

15. The compact cylindrical microstrip antenna, as recited in claim 14, further comprising said second patch being conductive.

16. The compact cylindrical microstrip antenna, as recited in claim 15, further comprising said first patch, having a first width narrower than a second width of said second patch.

17. The compact cylindrical microstrip antenna, as recited in claim 16, further comprising:

said second patch is adjacent to said first patch;

an RF connector in proximity to said first conductive patch; and said second patch is wrapped around said microstrip substrate.

18. The compact cylindrical microstrip antenna, as recited in claim 17, further comprising said first patch being rectangular.

19. The compact cylindrical microstrip antenna, as recited in claim 18, further comprising said second patch being rectangular.

20. The compact cylindrical microstrip antenna, as recited in claim 19, wherein impedance matching is provided by adjusting the location of said RF connector relative to the point where said ground end is shorted to said ground plane.

21. The compact cylindrical microstrip antenna, as recited in claim 20, further comprising said RF connector being a coaxial feed.

22. The compact cylindrical microstrip antenna, as recited in claim 21, further comprising said first width of the first conductive patch being decreased to provide a reduced variation in radiation magnitude and a lower frequency.

23. The compact cylindrical microstrip antenna, as recited in claim 21, further comprising a ratio of said first width to said second width being decreased to further reduce said compact antenna length.

24. The compact cylindrical microstrip antenna, as recited in claim 23, further comprising said impedance transition length being orthogonal to said second width.

25. The compact cylindrical microstrip antenna, as recited in claim 24, further comprising:

said first patch is connected to said RF connector; and said RF connector is disposed on an interior surface of said ground plane.

26. The compact cylindrical microstrip antenna, as recited in claim 25, further comprising said azimuth radiation pattern being about 360°.

27. The compact cylindrical microstrip antenna, as recited in claim 26, further comprising a 360° azimuth radiation pattern.

* * * * *